US008317668B2

(12) United States Patent
Sales et al.

(10) Patent No.: US 8,317,668 B2
(45) Date of Patent: Nov. 27, 2012

(54) EXERCISE DEVICE FOR ABDOMINAL AND OTHER CORE MUSCLES

(75) Inventors: Angela Sales, West Orange, NJ (US); Bruce Coody, Spring, TX (US)

(73) Assignee: Angela Sales, West Orange, NJ (US)

( * ) Notice: Subject to any disclaimer, the term of this patent is extended or adjusted under 35 U.S.C. 154(b) by 0 days.

(21) Appl. No.: 13/073,353

(22) Filed: Mar. 28, 2011

(65) Prior Publication Data

US 2011/0319236 A1 Dec. 29, 2011

Related U.S. Application Data

(63) Continuation of application No. 12/422,026, filed on Apr. 10, 2009, now abandoned.

(60) Provisional application No. 61/060,300, filed on Jun. 10, 2008.

(51) Int. Cl.
*A63B 22/14* (2006.01)
*A63B 26/00* (2006.01)

(52) U.S. Cl. ..... 482/140; 482/146; 482/147

(58) Field of Classification Search ..... 482/146–147, 482/77, 121, 123, 114–118, 140; *A63B 22/14, A63B 26/00*

See application file for complete search history.

(56) References Cited

U.S. PATENT DOCUMENTS

| | | | | |
|---|---|---|---|---|
| 1,521,946 | A * | 1/1925 | Hargreaves | 482/147 |
| 3,802,701 | A * | 4/1974 | Good, Jr. | 482/119 |
| 4,249,727 | A * | 2/1981 | Dehan | 482/117 |
| 4,494,662 | A * | 1/1985 | Clymer | 482/123 |
| 4,946,160 | A * | 8/1990 | Bertoletti | 482/71 |
| 5,092,586 | A * | 3/1992 | Tuthill et al. | 482/23 |
| 7,374,522 | B2 * | 5/2008 | Arnold | 482/146 |
| 7,419,459 | B2 * | 9/2008 | Van Straaten | 482/70 |
| 7,559,881 | B1 * | 7/2009 | Roraff | 482/129 |

* cited by examiner

*Primary Examiner* — Loan Thanh
(74) *Attorney, Agent, or Firm* — Schnader Harrison Segal & Lewis LLP

(57) ABSTRACT

A device for exercising the abdominal and other core muscles of a user comprises a rotatable base having a central opening therein, and a bar removably insertable into the opening. The bar may comprise two or more separable segments and may have provide for the attachment and removal of weights to provide resistance to a user. Also disclosed is a method of exercising using such a device.

12 Claims, 5 Drawing Sheets

EXERCISE DEVICE FOR ABDOMINAL AND OTHER CORE MUSCLES

CROSS-REFERENCE TO RELATED APPLICATIONS

This application is a continuation of patent application Ser. No. 12/422,026, filed Apr. 10, 2009, which in turn claims the priority of U.S. provisional patent application No. 61/060,300, filed Jun. 10, 2008. Both priority applications are hereby fully incorporated by reference.

FIELD OF THE INVENTION

This invention relates to the field of exercise devices, especially exercise devices for the abdominal and other core muscles.

BACKGROUND OF THE INVENTION

In the field of exercise devices, inventors have developed devices for use in exercising a user's abdominal and other core muscles. Inventors have employed various devices that allow the user to exercise the abdominal and other core muscles through relative motion of the user's upper body and lower body, including bending motions and twisting motions.

Of the mechanisms used to allow exercise by a twisting motion, some mechanisms provide a rotating base on which the user may stand and twist the upper body and lower body relative to each other from side to side. Some such mechanisms provide fixed handles that may be gripped by the user while standing on a rotating base, as disclosed in U.S. Pat. No. 7,118,519 to Slowinski, U.S. Pat. No. 4,305,579 to Rice, and U.S. Pat. No. 5,433,690 to Gilman. A contrary approach is disclosed in U.S. Pat. No. 4,249,727 to Dehan, which discloses a mechanism in which the user stands on a fixed base and moves a bar mounted to the base in a ball-and-socket fitting so as to provide resistance against the user when the user attempts to move the bar. In addition, an exercise device has been sold consisting of a rotatable base on which the user may stand and rotate the user's upper body relative to the upper body, but with no handle or bar for gripping by the user.

SUMMARY OF THE INVENTION

The exercise device disclosed herein is an exercise device that works the abdominal and other core muscles, including the lower back and obliques. The device includes two principal parts: a rotatable base having a central opening, and a bar removably insertable into the central opening. The user exercises by standing on the rotatable base and inserting the bar into the central opening, which is sized to accept the bar. The user twists so that his or her upper body moves relative to his or her lower body; while doing so with the bar inserted in the central opening, the user may use the bar to aid balance or to aid the relative twisting of the upper and lower body. The user may also remove the bar from the central aperture and use movement while carrying the weight of the bar to provide additional resistance for exercising the user's upper body, including the rear deltoids, upper back, and legs by providing additional weight to resist the user's movements.

Optionally the bar may include a plurality of segments that may be connected or separated as needed for various exercises. One example of such a bar may include a first connectable bar segment and a second connectable bar segment that are releasably coupled and thus may be separated. The lengths and weights of the bar segments may be essentially identical or may differ significantly. Bar segments that are relatively close in length and weight are preferred for allowing the user to hold one bar segment in each hand; bar segments that differ significantly in length or weight allow the user to use only one bar segment or the other to provide a desired weight and length for exercising.

DESCRIPTION OF THE DRAWINGS

The invention is best understood from the following detailed description when read with the accompanying drawings.

DETAILED DESCRIPTION OF THE INVENTION

Figure 1:
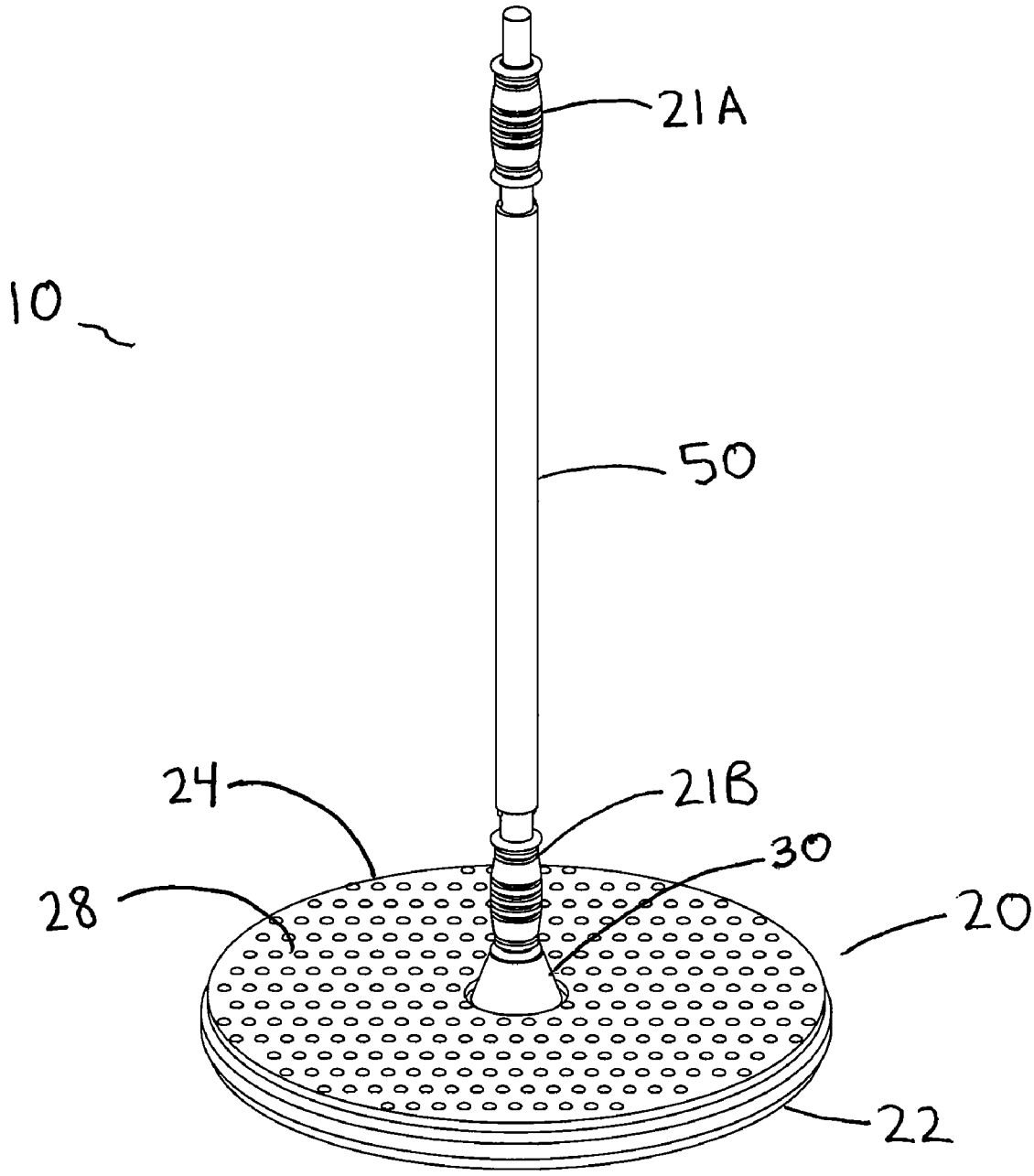
FIG. 1 shows a base and a bar removably inserted into the central aperture according to an illustrative embodiment of the invention.
Figure 2:
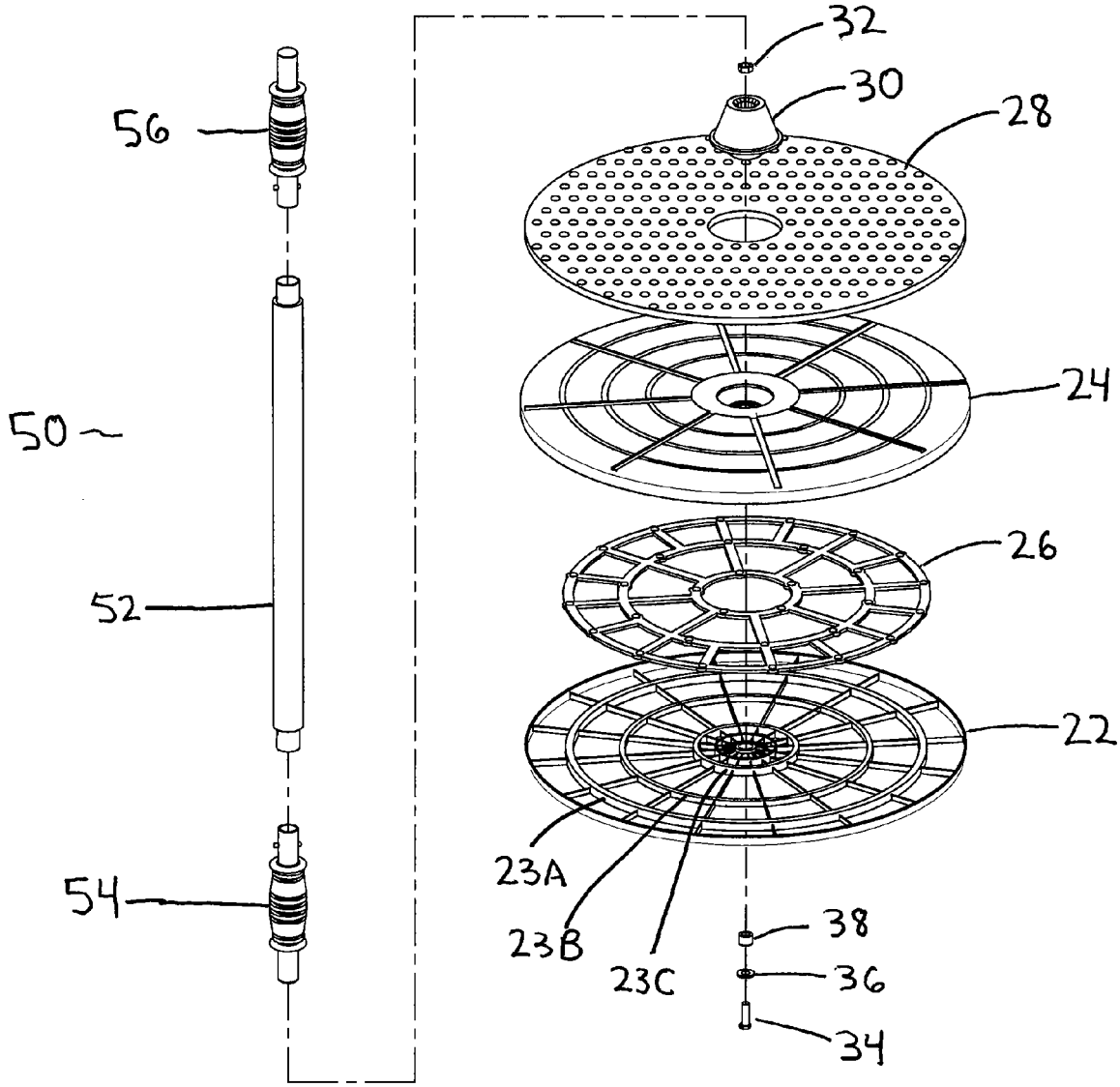
FIG. 2 shows an assembly view of a base and a bar according to an illustrative embodiment of the invention.

An illustrative embodiment of the exercise device 10 according to the invention includes two principal parts, as shown in FIG. 1 and FIG. 2: a rotatable base 20 having a central opening 23, and a bar 50 equipped with hand grips 21A and 21B (preferably of rubber or other elastic material) removably insertable into the central opening. The rotatable base 20 includes a lower base section 22 that rests upon an exercise surface. The rotatable base 20 also includes an upper base section 24 rotatably mounted on the lower base section 22. The rotation of the upper base may be provided by conventional ball bearings captured in races.

Preferably the lower base section 22 and the upper base section 24 are round, generally flat pieces; and in some embodiments the upper base section 24 is a round, generally flat piece about 41 to 46 centimeters or about 16 to 18 inches in diameter, with the height of the base being about 3.8 cm or about 1.5 inches. The rotatable base 20 has a central opening 23 in its upper surface with a bar releasably inserted therein. The bar 50 fits within the opening 23 so that the bar may be moved relative the rotatable base 20. The bar 50 or the opening 23 (or both) may be fitted with a rubber or other conformable surface; this may take the form of a thimble-shaped insert or boot 30, preferably of rubber or other elastic material, placed within the opening 23. The opening 23 is formed in the upper surface of the upper base section 24 and is a depression of sufficient depth to aid the user in maintaining the position of the bar 50 in the depression if so desired for a particular exercise. The upper base section 24 may be mounted on the lower base section 22 by means of conventional bearings and races and is secured to the lower base section by bolt 34 and nut 32, or alternatively means of clips or screws, to prevent the upper base section 24 from separating from the lower base section 22. In the embodiment illustrated in FIG. 1 and FIG. 2, the bolt 34 and nut 32 are augmented by washer 36 and spacer 38. Optionally bearings and races are supported by frame 26. Optionally lower base section 22 has a ribbed pattern and includes circular channels 23A, 23B, and 23C in which bearings from frame 26 will run. Optionally the lower base section 22 may include a support frame for supporting a plurality of bearings for rotatably supporting the upper base section on the lower base section. Optionally the top surface of base 20 is topped by contoured rubber pad 28.

The user may exercise by placing the rotatable base 20 on an exercise surface, standing on the rotatable base 20, and inserting the bar 50 into the central opening 23. The user twists his or her upper body and lower body relative to one another; while doing so with the bar 50 inserted in the central opening 23, the user may use the bar 50 to aid balance or to aid the relative twisting of the upper and lower body. The user may also remove the bar 50 from the central aperture 23 and use movement of the bar 50 to provide additional exercise for user's upper body.

Figures 3A, 3B:
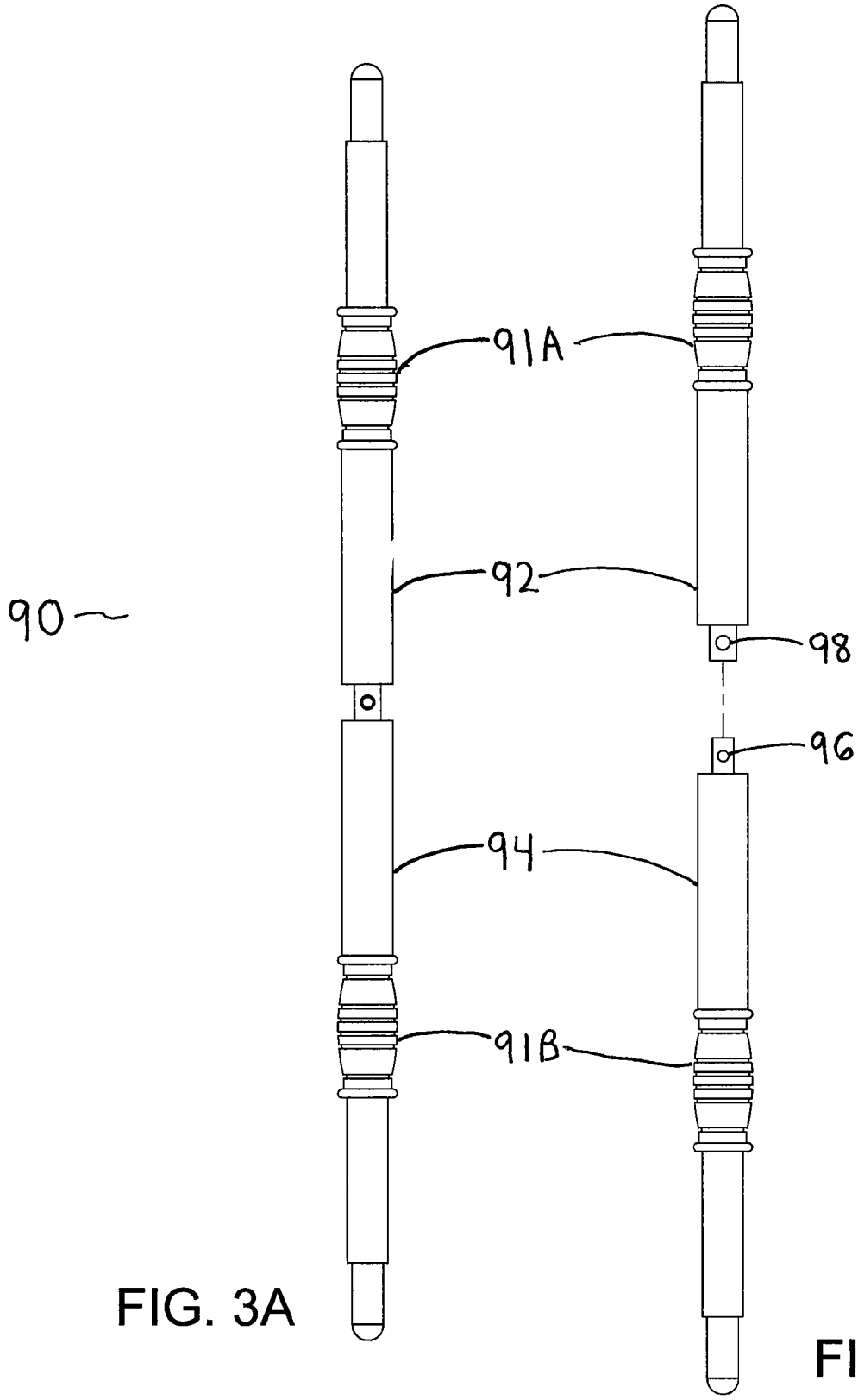
FIG. 3A shows a bar according to an illustrative embodiment of the invention in a connected state.
FIG. 3B shows the same bar in a disconnected state.
Figure 4:
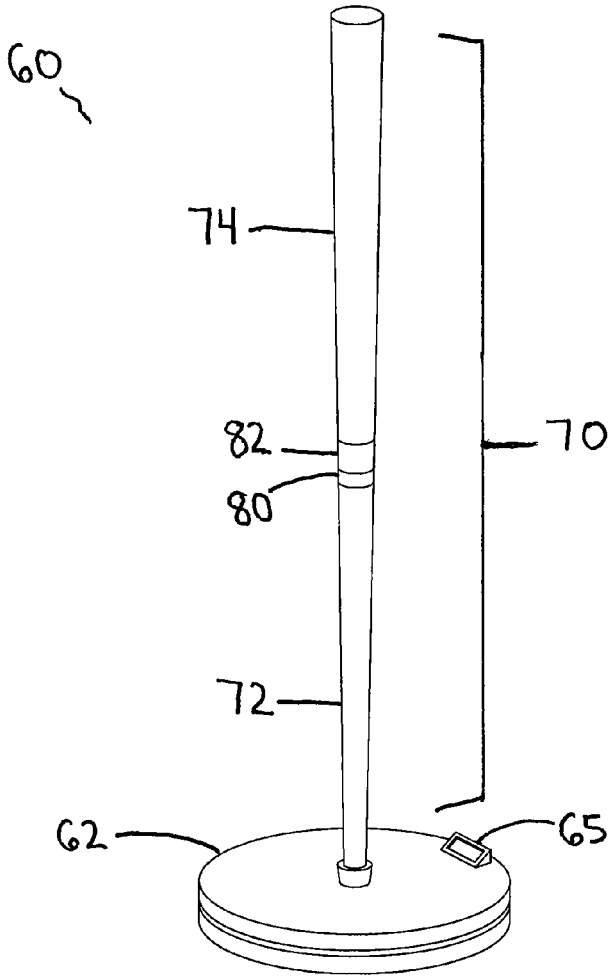
FIG. 4 shows a base and a bar removably inserted into the central aperture according to an illustrative embodiment of the invention.
Figure 5:
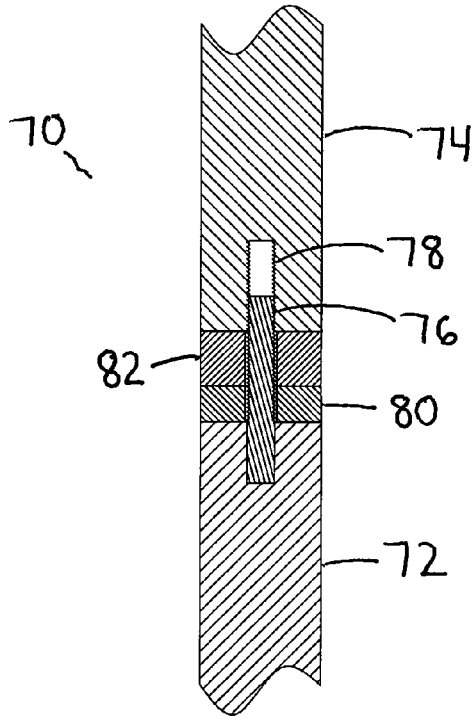
FIG. 5 is a partial cross-sectional view of the bar shown in FIG. 4.

Optionally, as shown in FIGS. 3A and 3B, a bar 90 may comprise a first releasably coupled bar segment 92 and a second releasably coupled bar segment 94, with the coupling device comprising a spring-loaded protruding button 96 that mates with an aperture 98 to fasten the two segments together. Also optionally, the bar 90 may include hand grips 91A and 91B. The bar segments 92 and 94 may in other embodiments be connected by other means. Optionally, as shown in FIG. 4 and FIG. 5, male threaded coupling 76 at one end bar segment 72 is fitted to a corresponding threaded coupling 78 of bar segment 74. Optionally and again as shown in FIG. 4 and FIG. 5, the bar 70 may include additional weights 80 and 82, which are circular disks each having a central aperture allowing them to be slipped over male threaded coupling 76 and secured between bar segments 72 and 74. The lengths and weights of the bar segments 72 and 74 may be essentially identical or may differ significantly. For example, each bar segment may be about 76 cm to 100 cm or about 2.5 to 3 feet in length, with a total assembled bar length of about 150 to 200 cm or about 5 to 6 feet. A first bar segment may weigh about 0.9 kilograms or 2 pounds and be supplied with a second bar segment weighting about 2.3 kg or about 5 pounds. Bar segments that are relatively close in length and weight are preferred for allowing the user to hold one bar segment in each hand; bar segments that differ significantly in length or weight allow the user to use only one bar segment or the other to provide a desired weight and length for exercising.

Optionally the device may include a conventional timer or calorie counter of the type that calculates a number of calories burned based on the user's weight and elapsed exercise time. Optionally, the device may include a counter that displays the number of "twists" or movements completed by the user. If a timer, calorie counter, or other counter is provided, a display 65, as shown in FIG. 4, or a display 125, as shown in FIG. 6, may be mounted on the base or elsewhere.

Figure 6:
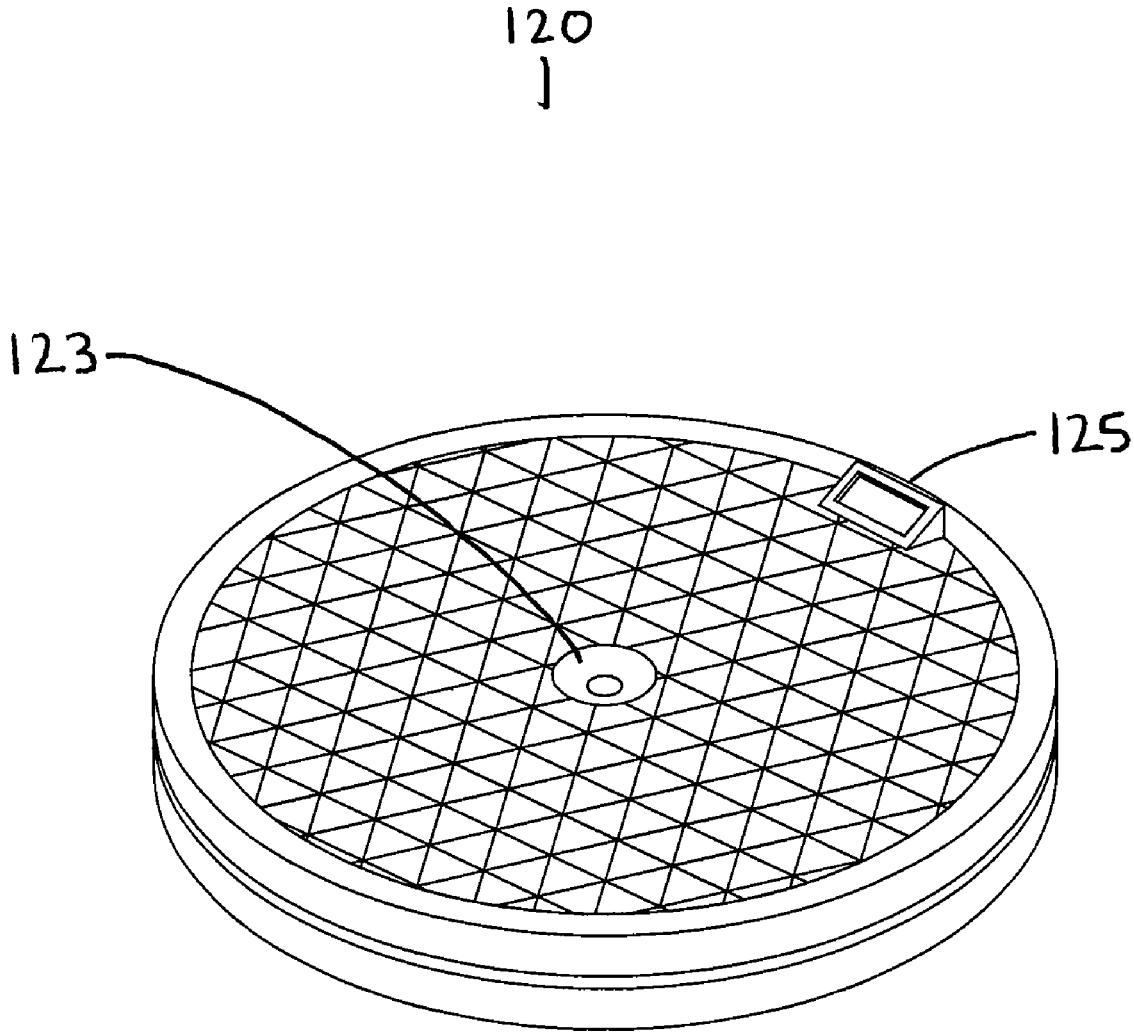
FIG. 6 shows an illustrative embodiment of a base according to the invention.

Preferably the upper base section 22 and the lower base section 24 are constructed from aluminum, plastic, or other sturdy material, with the upper surface of the upper section having a surface providing some traction for the feet of the user, such as provided by use of a friction material such as rubber pad 28 shown in FIG. 1 and FIG. 2, or by use of protrusions, depressions, grooves, as shown in FIG. 6, or other contours formed on the surface.

An alternative embodiment of a base 120 is shown in FIG. 6. In that embodiment, opening 123 could have a depth of less than 1.3 cm, or about 0.5 inches.

While the invention has been described by illustrative embodiments, additional advantages and modifications will occur to those skilled in the art. Therefore, the invention in its broader aspects is not limited to specific details shown and described herein. Modifications may be made without departing from the spirit and scope of the invention. For example, modifications may be made to the weight or length of bar segments, to the size of the rotatable base sections; to the mechanism used to support the upper base section on the lower base section or to couple those two sections together; and to the materials of construction. Accordingly, it is intended that the invention not be limited to the specific illustrative embodiments, but be interpreted within the full spirit and scope of the appended claims and their equivalents.

Claimed is:

1. A device for exercising the muscles of a user, comprising:

a horizontally rotatable circular base having a central opening therein, an elastic boot inserted into the central opening of the base; and a segmented bar removably insertable into the opening; wherein said boot is thimble-shaped and supports by friction fit the bar standing in the base in a generally vertical position; wherein said rotatable base has an upper base section and a lower base section and a frame having bearings with races disposed thereon, wherein the upper base section and the lower base section are disposed adjacently with the frame disposed between the upper and lower base sections, and wherein said lower base section has channels in which the bearings may move when the frame is rotated; and wherein said segmented bar comprises at least two releasably coupled segments.

2. A device according to claim 1, where the segments are essentially equal in weight.

3. A device according to claim 1, where the segments are not essentially equal in weight.

4. A device according to claim 1, further comprising weights attachable to the bar to provide additional resistance to the user.

5. A device according to claim 1, wherein the bar comprises a cushioned gripping surface.

6. A device for exercising, comprising:

a horizontally rotatable base, said base comprising an upper base section, a lower base section, and means to mount the upper base section rotatably and adjacent to the lower base section; said sections being round and flat; said upper base section having a central circular opening with a diameter;

an elastic boot, said boot having a boot opening, said boot being releasably insertable into the central circular opening of the upper base section; said boot being capable of receiving the bar and retaining it in a generally vertical position in the boot opening; and a bar; said bar comprising at least two cylindrical segments each having a diameter that approximates the diameter of said central circular opening of the upper base section; and said bar comprises a first bar segment releasably coupled to at least one second bar segment;

wherein the rotation plane of the upper base section remains parallel to the lower base section, and is generally horizontal with respect to the bar when the bar is inserted into the boot.

7. The device of claim 6, further comprising at least one circular disk having a central aperture; said disk being capable of being secured between bar segments.

8. The device of claim 6, further comprising a counter or a timer on the upper base section.

9. The device of claim 6, said boot having a thimble shape.

10. The device of claim 6, said boot having an upside-down funnel shape.

11. The device of claim 6, said boot having an upper side and a lower side, where the boot opening is located on an upper side; and said lower side being in contact with the lower base section.

12. The device of claim 6, said horizontally rotatable base further comprising a frame having bearings with races disposed thereon and wherein said lower base section has channels in which the bearings may move when the frame is rotated.

* * * * *